US007415849B2

(12) United States Patent
Kim

(10) Patent No.: US 7,415,849 B2
(45) Date of Patent: Aug. 26, 2008

(54) PULLEY OF WASHING MACHINE

(75) Inventor: Young Soo Kim, Changwon-si (KR)

(73) Assignee: LG Electronics Inc., Seoul (KR)

( * ) Notice: Subject to any disclaimer, the term of this patent is extended or adjusted under 35 U.S.C. 154(b) by 626 days.

(21) Appl. No.: 10/929,374

(22) Filed: Aug. 31, 2004

(65) Prior Publication Data

US 2005/0172680 A1 Aug. 11, 2005

(30) Foreign Application Priority Data

Feb. 6, 2004 (KR) ..... 10-2004-0007891

(51) Int. Cl.
*D06F 37/00* (2006.01)
*D06F 37/04* (2006.01)

(52) U.S. Cl. ..... 68/140; 74/571.11; 74/572.21

(58) Field of Classification Search ..... 68/23 R, 68/24, 58, 140; 74/572.1–574.4
See application file for complete search history.

(56) References Cited

U.S. PATENT DOCUMENTS 2,995,044 A * 8/1961 Abel ..... 474/91
4,946,427 A * 8/1990 Rampe ..... 474/161
5,129,865 A * 7/1992 Brock et al. ..... 474/152
5,345,792 A * 9/1994 Farrington et al. ..... 68/23.2
5,469,593 A * 11/1995 Cuthbert et al. ..... 8/159
5,735,006 A * 4/1998 Vande Haar ..... 8/158
5,870,907 A * 2/1999 Cho ..... 68/23.1
5,907,961 A * 6/1999 Lee et al. ..... 68/140

FOREIGN PATENT DOCUMENTS

FR 2633998 A * 1/1990
JP 2001316740 A * 11/2001

* cited by examiner

*Primary Examiner*—Joseph L. Perrin
(74) *Attorney, Agent, or Firm*—Ked & Associates LLP

(57) ABSTRACT

A pulley of a washing machine, wherein the weight of the pulley is reduced by forming a strain-focused portion of the pulley with a high-rigidity material. The pulley of the washing machine having a motor for rotating a drum connected to one end of a shaft, includes a composite member, axially coupled to the other end of the shaft, for transferring a rotational force of the motor to the drum, the composite member being formed of at least two materials having dissimilar tensile strengths.

5 Claims, 4 Drawing Sheets

PULLEY OF WASHING MACHINE

This application claims the benefit of Korean Application No. P2004-007891, filed on Feb. 6, 2004, which is hereby incorporated by reference.

BACKGROUND OF THE INVENTION

1. Field of the Invention

The present invention relates to a washing machine, and more particularly, to a pulley of a washing machine transferring a rotational force generated from a motor to a drum.

2. Discussion of the Related Art

Generally, a washing machine is a representative home appliance for removing filth or dirt attached to a laundry using a reaction between water and detergent. A washing machine is categorized into various types according to an impacting mechanism on a laundry. FIG. 1 is a cross-sectional diagram of a washing machine according to a related art. Referring to FIG. 1, a washing machine 1 consists of a case 10 forming an exterior and having a door 11 on its front side, a tub 20 fixed within the case 10, a drum 30 rotatably provided within the tub 20, and a motor 40 rotating the drum 30. The washing machine 1 further consists of a belt 50 and pulley 60 to transfer a rotational force of the motor 40 to the drum 30. The motor 40 is provided under the tub 20 and is connected to the belt 50. A shaft 31 is provided to a rear side of the drum 30. And, the pulley 60 is coupled to the shaft 31.

FIG. 2 is a front diagram of a pulley according to the related art. Referring to FIG. 2, the pulley 60 has a cylindrical shape having an open front side. A groove (not shown) is formed on a circumference of the pulley to be coupled to the belt 50. A hole 61 is formed in a center of the pulley 60 to be coupled to the shaft 31. And, the pulley 60 is formed of a steel based material having high rigidity to transfer the rotational force to the drum by overcoming the weight of the drum and the laundry therein. However, the related art pulley of the washing machine is formed of the steel based material, thereby becoming heavy to impose a load on the motor. Hence, damage is caused to the motor.

SUMMARY OF THE INVENTION

Accordingly, the present invention is directed to a pulley of a washing machine that substantially obviates one or more of the problems due to limitations and disadvantages of the related art.

An object of the present invention, which has been devised to solve the foregoing problem, lies in providing a pulley of a washing machine, by which weight of the pulley is reduced by forming a strain-focused portion of the pulley with a high-rigidity material.

Additional features and advantages of the invention will be set forth in the description which follows, and in part will be apparent to those having ordinary skill in the art upon examination of the following or may be learned from a practice of the invention. The objectives and other advantages of the invention will be realized and attained by the subject matter particularly pointed out in the specification and claims hereof as well as in the appended drawings.

To achieve these objects and other advantages in accordance with the present invention, as embodied and broadly described herein, a pulley of a washing machine having a motor for rotating a drum connected to one end of a shaft, includes a composite member, axially coupled to the other end of the shaft, for transferring a rotational force of the motor to the drum, the composite member being formed of at least two materials having dissimilar tensile strengths.

The composite member may include a wheel, and an axle piece, centrally disposed with respect to the wheel and coupled to the shaft of the drum, the material of the axle piece having a high tensile strength. Herein, the wheel may have an outer circumference for receiving a power transfer member coupled to the motor. The power transfer member is a belt. The axle piece may include a first contact surface for receiving the shaft, a second contact surface engaging with the wheel, and at least one tooth, radiating toward the outer circumference of the wheel, for increasing the area of the second contact surface and thereby dispersing a mechanical energy transmitted through the second contact surface when the drum is rotated. Herein, the axle piece may include three teeth. The teeth are arranged equidistantly about the axle piece.

The material of the wheel is more lightweight than the material of the axle piece. And, the wheel may include a rim supported by a plurality of radial spokes. Herein, the wheel may include a hub engaging with the axle piece. And, the axle piece may include a plurality of teeth, radiating toward the rim of the wheel, at least one tooth engaging with the hub at each radial spoke. The axle piece may be formed of steel and the wheel is formed of aluminum. And, the pulley may be formed by an insertion molding process.

In another aspect of the present invention, a washing machine includes a drum connected to one end of a shaft, a motor for rotating the drum, and a pulley having an inner portion coupled to the other end of the shaft and an outer portion for transferring a rotational force of the motor to the drum, the pulley being a composite of at least two materials having dissimilar tensile strengths, wherein the material of the inner portion has a high tensile strength and the material of the outer portion is more lightweight than the material of the outer portion.

The outer portion of the pulley may include a rim for receiving a power transfer member, and a plurality of radial spokes supporting the rim. The inner portion of the pulley may include at least one tooth for increasing a contact surface area engaging with the outer portion of the pulley, the at least one tooth engaging with the outer portion at each radial spoke. Herein, the inner portion of the pulley may be formed of steel, and the outer portion of the pulley may be formed of aluminum. The pulley may be manufactured by an insertion molding process.

It is to be understood that both the foregoing explanation and the following detailed description of the present invention are exemplary and illustrative and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiments of the invention and together with the description serve to explain the principle of the invention. In the drawings.

DETAILED DESCRIPTION OF THE PREFERRED EMBODIMENTS

Reference will now be made in detail to the preferred embodiments of the present invention, examples of which are illustrated in the accompanying drawings. Throughout the drawings, like elements are indicated using the same or similar reference designations where possible.

Figure 1:
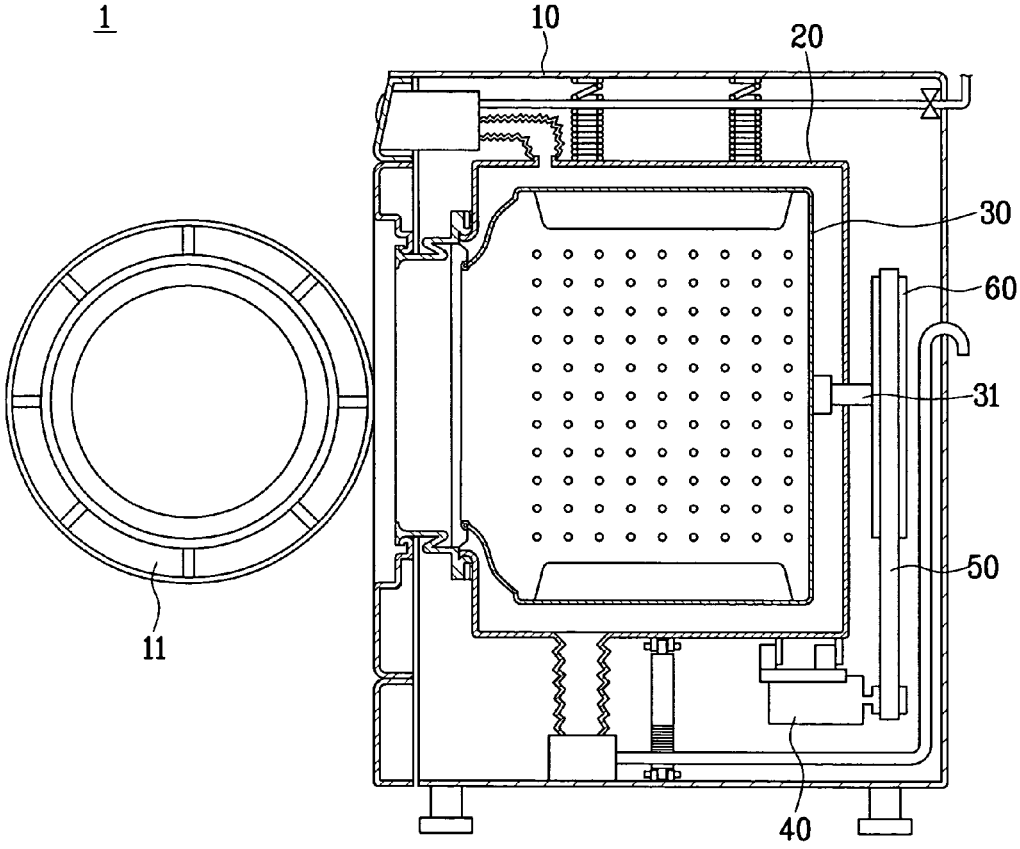
FIG. 1 Related Art
FIG. 1 is a cross-sectional diagram of a washing machine according to a related art.
Figure 2:
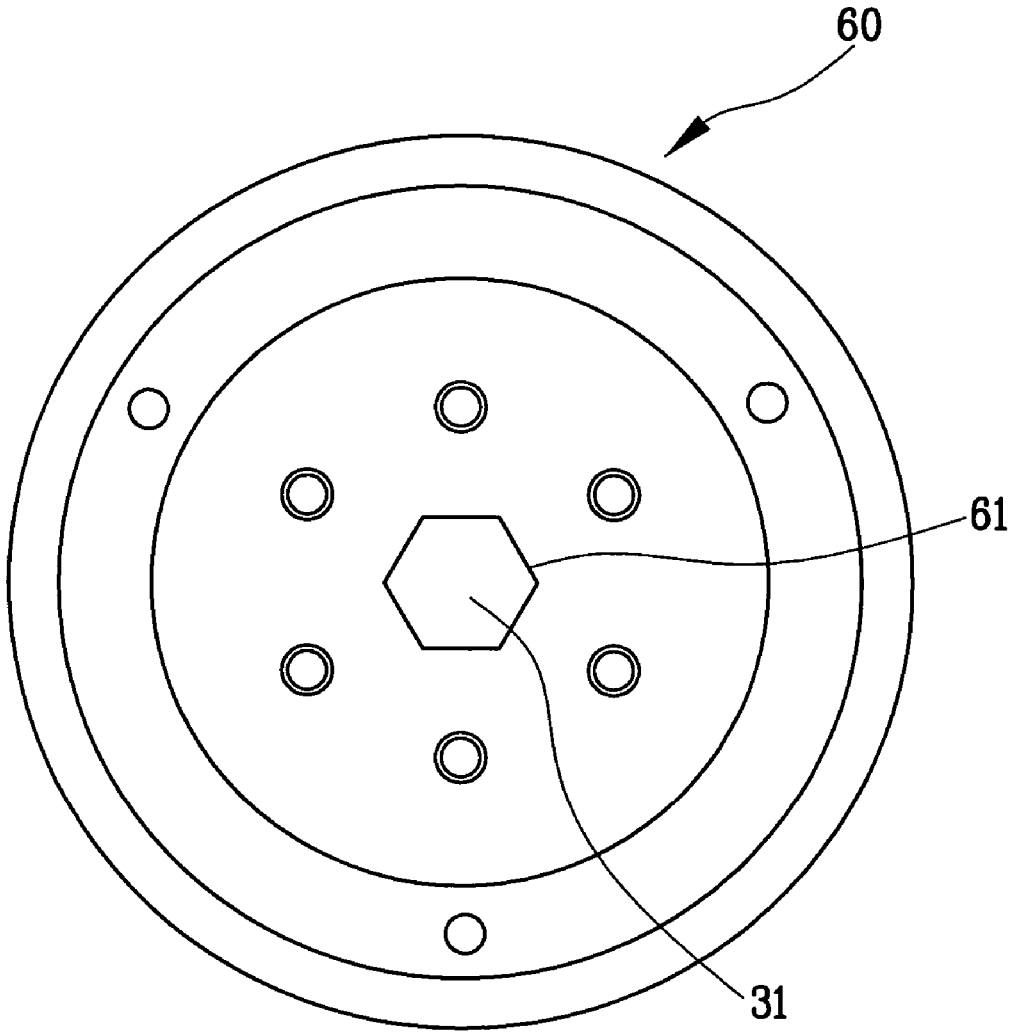
FIG. 2 Related Art
FIG. 2 is a front diagram of a pulley according to the related art.
Figure 3:
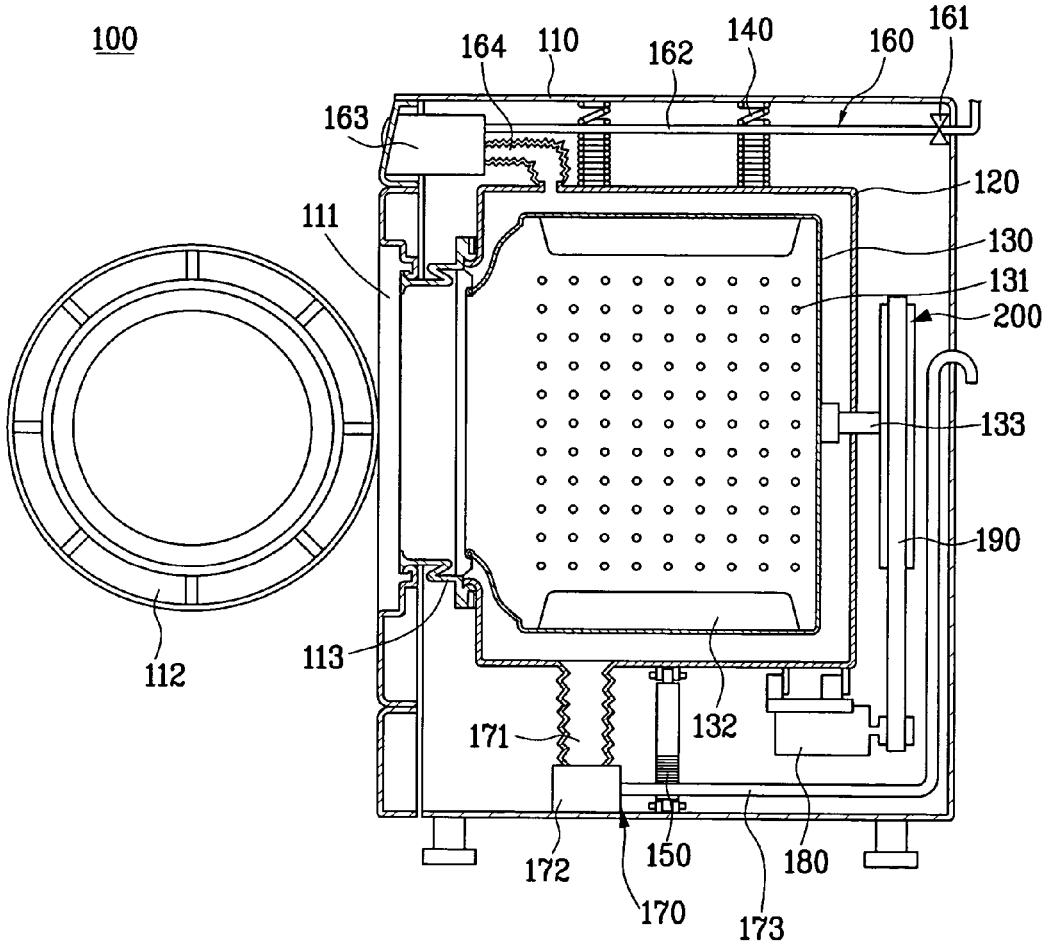
FIG. 3 is a cross-sectional diagram of a washing machine according to the present invention.
Figure 4:
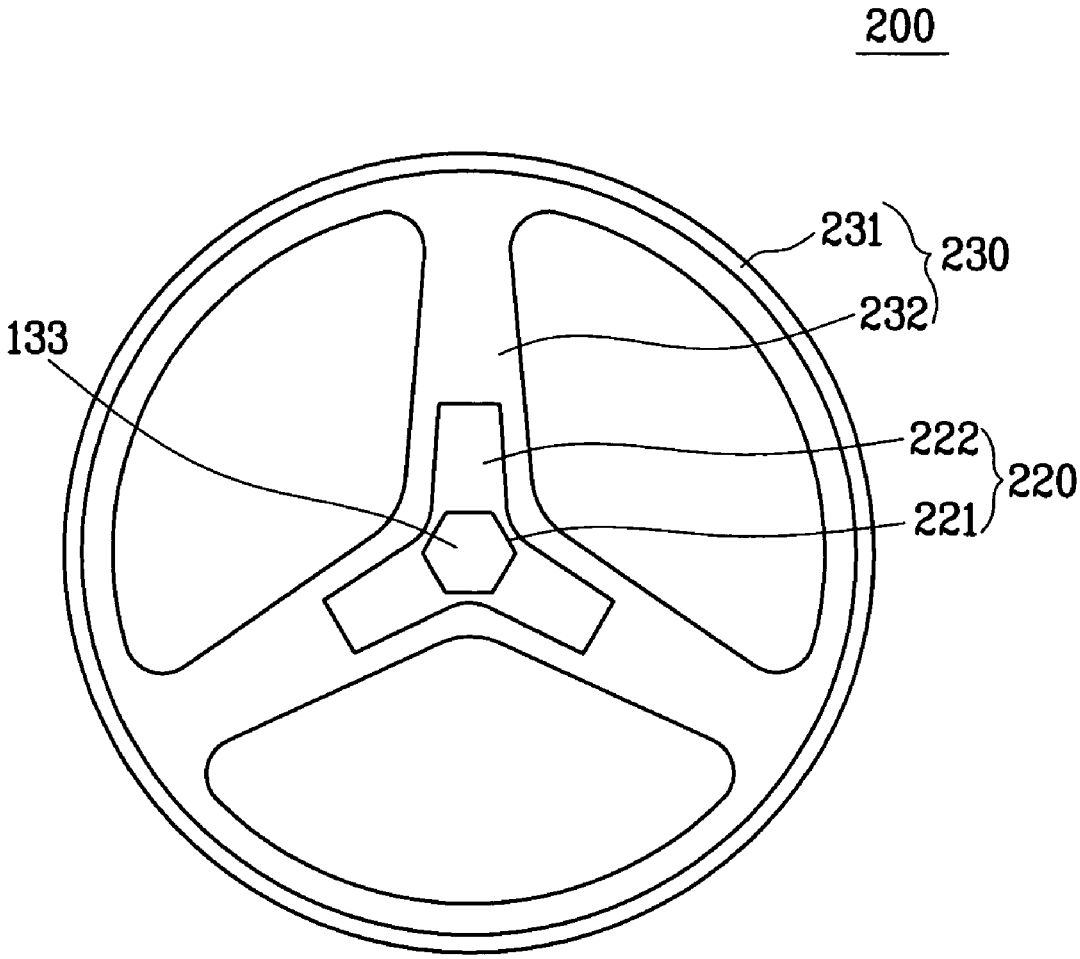
FIG. 4 is a front diagram of a pulley according to the present invention.

FIG. 3 is a cross-sectional diagram of a washing machine according to the present invention, and FIG. 4 is a front diagram of a pulley according to the present invention. Referring to FIG. 3, a case 110 forms an exterior of a washing machine 100 according to the present invention. A tub 120 is suspended within the case 110. For this, an upper part of the tub 120 is connected to a spring 140 fixed to the case 110 and a lower part of the tub 120 is connected to a damper 150 connected to a bottom surface of the case 110 via a hinge. The above-provided spring 140 and damper 150 play a role in attenuating vibration appearing on the tub 120 in the course of operating a washing machine as well as elastically suspending the tub 120 within the case 110.

A drum 130 is rotatably provided within the tub 120, which is explained in detail as follows. First of all, a multitude of perforated holes 131 perforate a circumference of the drum 130 and a plurality of tumbling ribs 132 are provided on an inner circumference of the drum 130. Hence, water supplied to the tub 120 enables to communicate between the drum 130 and the tub 120 via the perforated holes 131. A laundry held (or contained) in the drum 130 is lifted upward to fall by the tumbling ribs 132 while the drum 130 is rotated. Hence, friction and impact energy sufficient for washing can be provided when the laundry falls by the tumbling ribs 132. An opening 111 is provided to a front side of the case 110 so that a user can put/pull the laundry in/from the drum 130 and a door 112 is provided to open/close the opening 111. A gasket 113 is provided between the opening 111 of the case 110 and the tub 120 to prevent water/laundry held in the drum 130 and/or tub 120 from leaking/escaping.

Meanwhile, a water supply system 160 and drain system 170 are provided within the case 110. The water supply system 160 includes an inlet valve 161, an inlet hose 162, a detergent box 163, and an inlet bellows 164. The inlet valve 161 opens or closes a passage of water supplied from outside, and the inlet hose 162 connects the inlet valve 161 and the detergent box 163. And, the inlet bellows 164 connects the detergent box 163 and the tub 120. Once the inlet valve 161 is turned on, water is passed through the inlet hose 162, the detergent box 163, and the inlet bellows 164 in turn to be supplied to the tub 130. In this case, a detergent stored in the detergent box 163 is supplied to the water if necessary.

The drain system 170 includes a drain bellows 171, a drain pump 172, and a drain hose 173. The drain bellows 171 connects the tub 120 and the drain pump 172. One end of the drain hose 173 is connected to the drain pump 172 and the other end of the drain hose 173 communicates with outside of the case 110. Hence, once the drain pump 172 is driven, water held in the tub 120 is passed through the drain bellows 171, the drain pump 172, and the drain hose 173 in turn to be discharged outside.

Meanwhile, in order to rotate the drum 130, a motor 180 is provided within the case 110, and more particularly, under the tub 120. And, a pulley 200 and a power transfer member 190 are provided to transfer a rotational force of the motor 180 to the drum 130. In order to provide the rotational force generated from the motor 180 to the drum 130, the pulley 200 is coupled to the shaft 133 provided to the rear side of the drum 130 and is connected to the motor 180 by the power transfer member 190. In this case, the power transfer member 190 is a belt.

The pulley 200 includes a member 220 formed of at least two materials differing in rigidity from each other. Alternatively, one portion of the pulley 200 connected to the shaft 133 is formed of a high-rigidity material and the rest portion of the pulley 200 is formed of a lightweight material. The pulley 200 is explained in detail with reference to FIG. 4 as follows. The member includes a first member 220 coupled to the shaft 133 of the drum 130 and a second member 230 enclosing the first member 220. When the pulley 200 rotates the drum 130, strain is generated from the corresponding coupling part 221. The first member 220 is formed of a high-rigidity material to resist the strain focused on the portion where the shaft 133 is coupled. Specifically, the first member 220 includes a coupling part 221 coupled to the shaft 133 and a protruding part 222 protruding from the coupling part 221 to extend a contact area with the second member 230. In this case, the protruding part 222 plays a role in dispersing to transfer the strain to the generated second member 230.

Moreover, in order to disperse the strain more efficiently, the protruding part 222 protrudes from the coupling part 221 in three directions to leave a same interval from each other. Meanwhile, the second member 230 is formed of a lightweight material having rigidity lower than that of the first member 220. Specifically, the second member 230 includes a rim 231 having the power transfer member 190 wound thereon and a spoke 232 connecting the first member 220 and the rim 231. Moreover, a groove (not shown) is formed on an outer circumference of the rim 231 to have the power transfer member 190 fitted therein solidly.

The spoke 232 formed of a low-rigidity material may be transformed by the strain. In order to prevent the transformation of the spoke 232, the protruding part 222 is inserted in the spoke 232 to reinforce the spoke 232. By increasing the contact area between the spoke 232 and the protruding part 222, the strain is dispersed to prevent the spoke 232 from being damaged. Moreover, there are provided three spokes 232 to evenly support the rim 231. If the three spokes 232 are provided, less material is required for manufacturing the pulley 200. Preferably, the spokes 232 are arranged to leave the same interval from each other.

The materials of the pulley 200 are explained in detail as follows. First of all, the first member 220 is formed of steel having high rigidity and the second member 230 is formed of lightweight aluminum having low rigidity. Besides, the pulley 200 is preferably manufactured by insert molding.

The washing machine according to the present invention is operated in the following manner. First of all, after the drum 130 is filled with laundry, water, and detergent, the motor 180 is driven to rotate the pulley 200 via the power transfer member 190. As the pulley 200 is rotated, the drum 130 connected to the pulley 200 via the shaft 133 is rotated. By rotating the drum 130, the laundry is washed within the drum 130.

In doing so, the weight of the drum 130 including the laundry therein causes strain to the shaft 133 and pulley 200. Yet, one portion of the pulley 200 is formed of the high-rigidity material, thereby preventing the pulley 200 from being broken by the strain. Moreover, the rest portion of the pulley 200 is formed of the lightweight material to reduce the weight of the pulley 200. Thus, the load applied to the motor 180 is reduced, whereby the motor 180 enables to avoid being damaged. And, the one portion of the pulley 200 is inserted in the rest portion to reinforce the rest portion and to increase the contact area between the one portion and the rest portion.

Hence, the strain is dispersed to the rest portion from the one portion, whereby the pulley 200 is prevented from being broken.

It will be apparent to those skilled in the art that various modifications and variations can be made in the present invention without departing from the spirit or scope of the invention. Thus, it is intended that the present invention cover such modifications and variations, provided they come within the scope of the appended claims and their equivalents.

What is claimed is:

1. A pulley for a washing machine, wherein the pulley is coupled to a shaft that rotates a drum of the washing machine, and wherein a power transfer member transfers power from a motor of the washing machine to the pulley, the pulley comprising:

a first member which is configured to be coupled to the shaft of a washing machine, wherein the first member comprises:

a coupling part that couples the first member to the shaft; and at least three protruding parts that protrude from the coupling part in equally spaced radial directions; and a second member that is attached to the first member, wherein the second member comprises:

a rim that is configured to receive the power transfer member; and at least three spokes that are coupled to the rim and to corresponding ones of the at least three protruding members, wherein each of the at least three protruding parts are inserted into a center of a corresponding one of the spokes such that a rotational force imparted to the rim by the power transfer member can be transferred to the coupling part, wherein an interface between the at least three protruding parts and the corresponding spokes spreads the rotational force imparted by the power transfer member, and wherein each protruding part extends at least a portion of the way up the length of a corresponding spoke.

2. The pulley of claim 1, wherein the first member is formed of a high tensile strength material, and wherein the second member is formed of a material that is lighter in weight than the first material.

3. The pulley of claim 1, wherein each of the at least three protruding parts narrows as it extends away from the coupling part.

4. The pulley of claim 1, wherein front and rear surfaces of the at least three protruding parts are exposed outside the spokes.

5. A washing machine comprising the pulley of claim 1.

* * * * *